US007644748B2

(12) United States Patent
Liang et al.

(10) Patent No.: US 7,644,748 B2
(45) Date of Patent: Jan. 12, 2010

(54) CONTROL MECHANISM FOR SLATS OF BLINDS

(76) Inventors: Wen Ying Liang, No.373, Sec. 4, Yanhai Rd., Fuxing Shiang, Changhua County 506 (TW); Sheng Ying Hsu, No.373, Sec. 4, Yanhai Rd., Fuxing Shiang, Changhua County 506 (TW); Wu Chung Nien, No.373, Sec. 4, Yanhai Rd., Fuxing Shiang, Changhua County 506 (TW); Chien Chih Huang, No.373, Sec. 4, Yanhai Rd., Fuxing Shiang, Changhua County 506 (TW)

( * ) Notice: Subject to any disclaimer, the term of this patent is extended or adjusted under 35 U.S.C. 154(b) by 233 days.

(21) Appl. No.: 11/806,697

(22) Filed: Jun. 4, 2007

(65) Prior Publication Data

US 2008/0295977 A1 Dec. 4, 2008

(51) Int. Cl.
*E06B 9/30* (2006.01)

(52) U.S. Cl. ..... 160/171

(58) Field of Classification Search ..... 160/170, 160/171, 84.02, 84.04, 84.05, 168.1 R, 173 R, 160/178.1 R; 185/37, 45
See application file for complete search history.

(56) References Cited

U.S. PATENT DOCUMENTS

| | | | | |
|---|---|---|---|---|
| 2,250,106 | A * | 7/1941 | Lorentzen | 160/170 |
| 5,103,888 | A * | 4/1992 | Nakamura | 160/171 |
| 6,662,850 | B2 * | 12/2003 | Chung et al. | 160/171 |
| 6,957,683 | B2 * | 10/2005 | Toti | 160/170 |
| 2004/0182522 | A1 * | 9/2004 | Strand et al. | 160/84.05 |
| 2006/0070706 | A1 * | 4/2006 | Lin | 160/171 |
| 2007/0151675 | A1 * | 7/2007 | Nien et al. | 160/84.05 |
| 2008/0083509 | A1 * | 4/2008 | Hsu et al. | 160/84.05 |

* cited by examiner

*Primary Examiner*—Blair M. Johnson

(57) ABSTRACT

A control mechanism for a cordless blind includes a transmission unit, a scrolling unit and a tilt unit. The transmission unit has a transmission cable which is connected with a scrolling rod. The scrolling unit includes two scrolling cables which have respective one of two ends thereof wrapped to two ends of the rod, and the other end of each scrolling cables extends through the top rail, extends through parallel slats and is connected to a bottom rail. The tilt unit includes a tilt member with two tilt cables connected to two ends thereof the tilt member, the other end of the tilt cable extend through the top rail and are connected to the parallel slats. A tilt wand is used to rotate the tilt member to move the tilt cables moved upward and downward so as to tilt the slats.

4 Claims, 7 Drawing Sheets

CONTROL MECHANISM FOR SLATS OF BLINDS

FIELD OF THE INVENTION

The present invention relates to a control mechanism for controlling the slats of cordless blinds up and down.

BACKGROUND OF THE INVENTION

A conventional blind generally includes a head which is fixed to the wall and a control mechanism is received in the head. A top rail is connected to the head and a plurality of slats are connected between the top rail and the bottom rail. Some of the conventional blinds are equipped with a lift cord which hangs on the head and the user can pulls the lift cord to move the slats upward or downward. However, the hanging lift cord has a potential risk for the children. Some of the conventional blinds do not need the lift cord and includes a control mechanism and a transmission unit which is connected with a plurality of cords and a transmission cable. The control mechanism provides torque to control the operation of the cords and transmission cable to move the slats up and down. The conventional cordless blind cannot tilt the slats.

The present invention intends to provide a control mechanism for cordless blinds and the control mechanism controls the slats upward and downward movement and also controls the tilt angle of the slats.

SUMMARY OF THE INVENTION

The present invention relates to a cordless blind which comprises a top rail and a transmission unit, a scrolling unit and a tilt unit are respectively received in the space defined in the head. The transmission unit includes a transmission cable extending therefrom which is connected with a scrolling rod. The scrolling unit includes two scrolling cables which have respective one of two ends thereof wrapped to two ends of the rod, and the other end of each scrolling cables extends through the top rail and the parallel slats and is connected to a bottom rail. A tilt unit includes a tilt member and respective one of two ends of two tilt cables is connected to two ends of the tilt member, the other end of each tilt cable extends through the top rail and is connected to the parallel slats. The tilt unit further includes a tilt wand which is able to rotate the tilt member to move the tilt cables moved upward and downward so as to tilt the slats.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
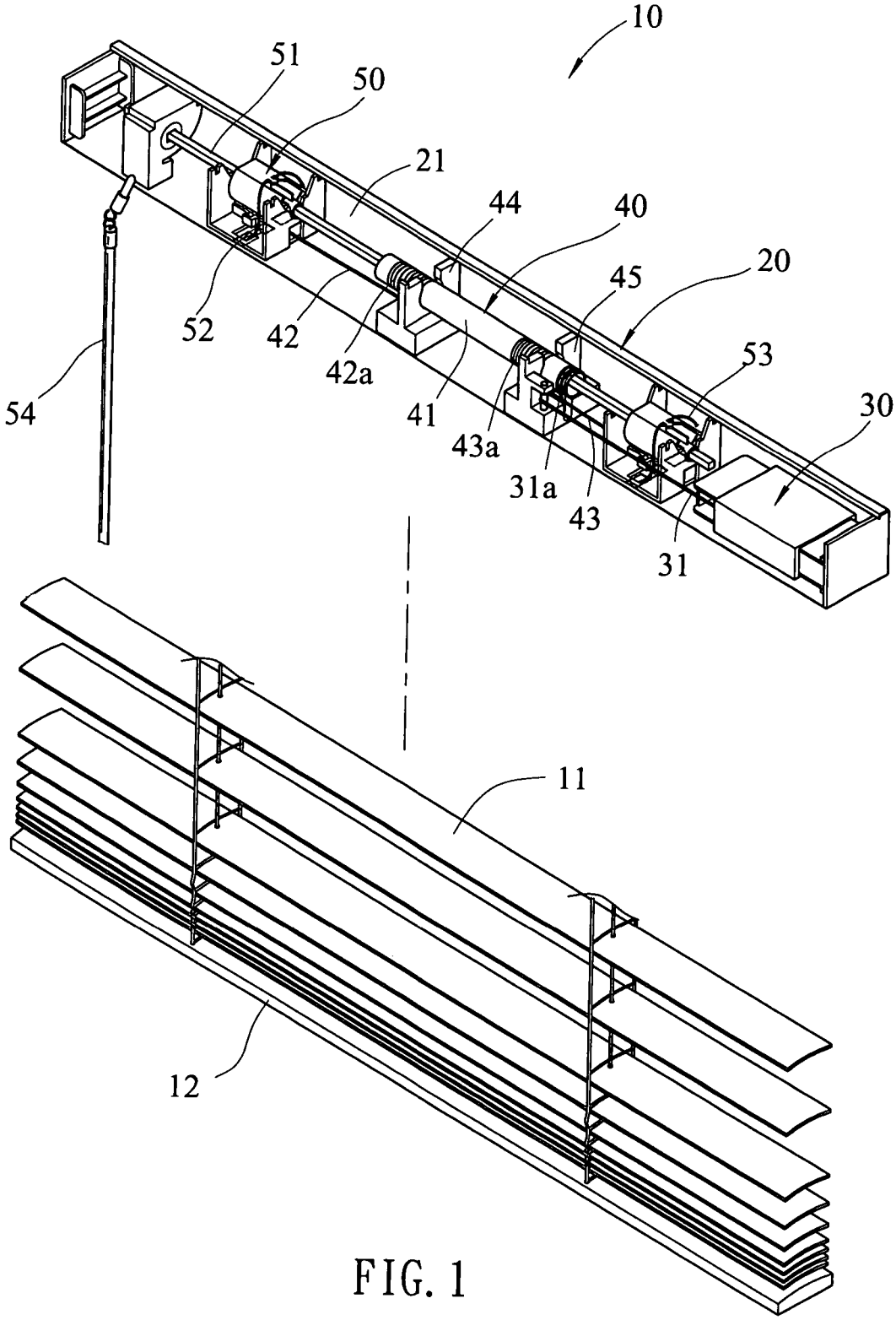
FIG. 1 is a perspective view to show the cordless blind of the present invention.
Figure 2:
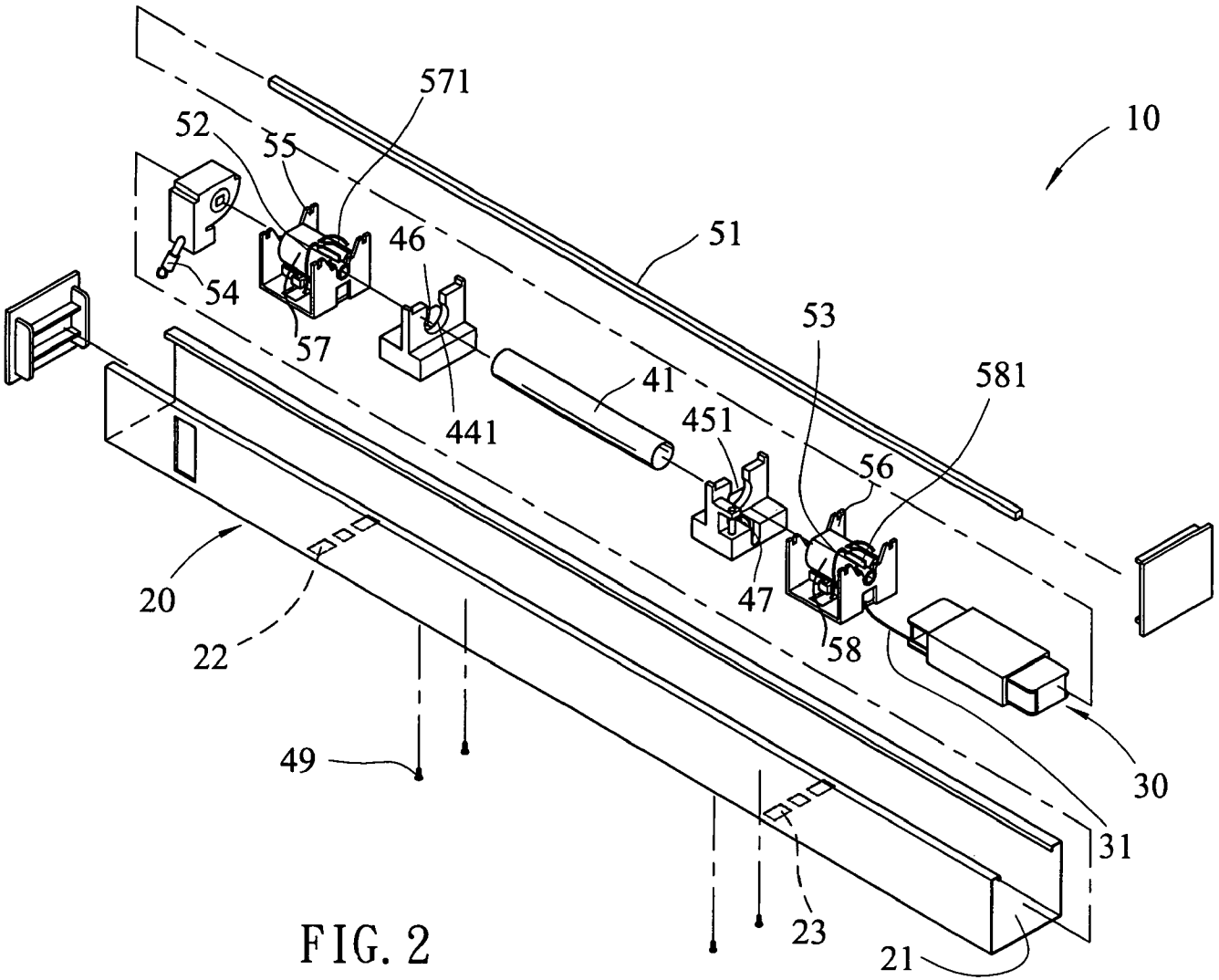
FIG. 2 is an exploded view to show the control mechanism of the cordless blind of the present invention.

Referring to FIGS. 1 and 2, the cordless blind of the present invention comprises a top rail 20 which has a space 21 defined therein, a control mechanism 10 received in the space, a plurality of slats 11, and a bottom rail 12. The slats 11 are located between the top and bottom rails 20, 12.

The control mechanism 10 includes a transmission unit 30, a scrolling unit 40 and a tilt unit 50. The transmission unit 30 is received in the space 21 and has a transmission cable 31 extending therefrom. One end of the transmission cable 31 is wrapped to an end of a scrolling rod 41 to form a first wrapping portion 31*a*.

The scrolling unit 40 is received in the space 21 and has two scrolling cables 42, 43 which have respective one of two ends thereof wrapped to two ends of the rod 41 to form the second and third wrapping portions 42*a* and 43*a*. The other end of each scrolling cables 42/43 extends through the top rail 20 and the parallel slats 11 and is connected to a bottom rail 12. The scrolling unit 40 includes two supports 44, 45 fixedly connected to eh top rail 20 by screws 49 so as to support the scrolling rod 41. Two pulleys 46, 47 are connected to the two supports 44, 45 and the scrolling cables 42, 43 reeve through the two pulleys 46, 47 and then are wrapped to the scrolling rod 41 to form the second and third wrapping portions 42*a*, 43*a*.

The tilt unit 50 is received in the space 21 and has a tilt member 51, wherein respective one of two ends of two tilt cables 52, 53 are connected to two ends of the tilt member 51, and the other end of each tilt cable 52/53 extend through the top rail 20 and are connected to the parallel slats 11. The tilt unit 50 further includes the two positioning members 55, 56 received in the space 20 and two spinning members 57, 58 are engaged with the positioning members 55, 56 respectively. Each of the two positioning members 55, 56 has a holes 22/23 through which the scrolling cable 42/43 and the tilt cable 52/53 extend. The rollers 551, 561 are located in the holes 22, 23 so that the scrolling cables 42, 43 pass around the rollers 551, 561 at substantially right angle. Each of the two spinning members 57, 58 has an engaging port 571/581 so that the tilt cables 52, 53 are engaged with the engaging ports 571, 581.

Figure 3:
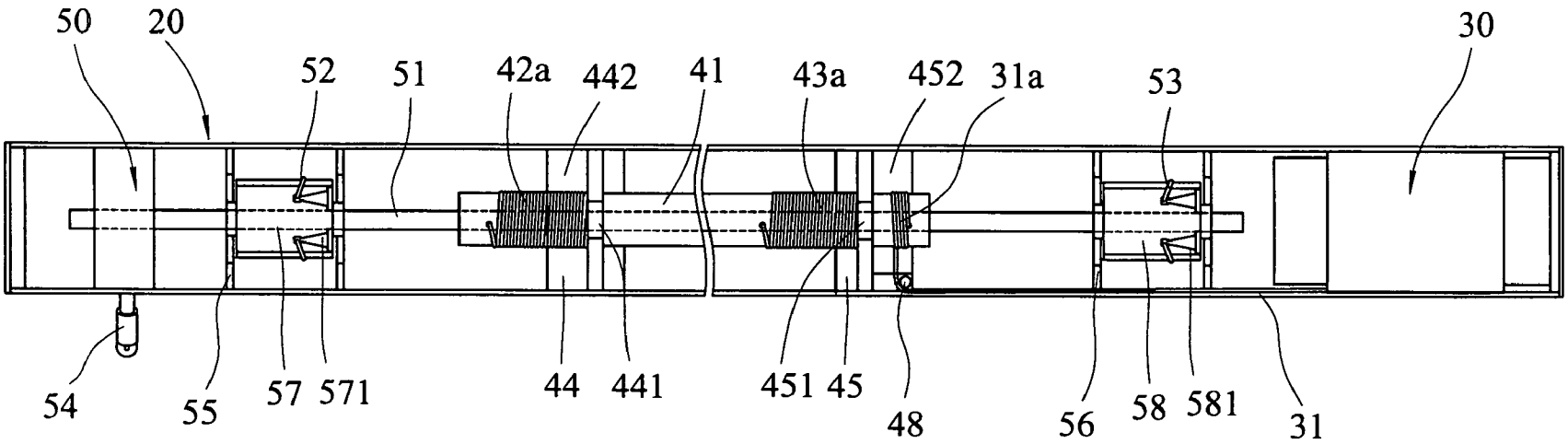
FIG. 3 is a top view of the control mechanism of the cordless blind of the present invention.

As shown in FIG. 3, the support 45 that is located close to the transmission unit 30 includes a tubular member 48 and the transmission cable 31 goes around the tubular member 48 and is wrapped to the scrolling rod 41 at a substantially right angle.

Figure 4A:
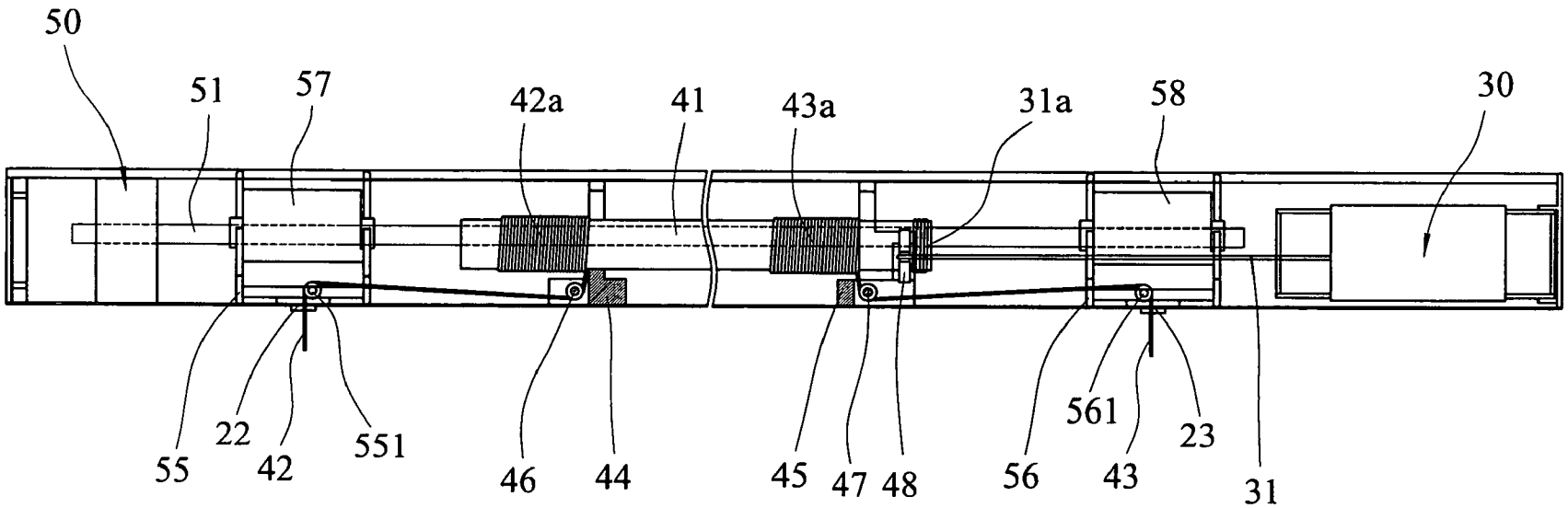
FIG. 4A shows the control mechanism of the cordless blind of the present invention, wherein the slats are collected with each other.

As shown in FIG. 4A, each of the two supports 44, 45 is an inverted T-shaped member and a notch 441/451 is defined in a top of each of the two supports 44, 45 such that the scrolling rod 41 is engaged with the two respective notches 441, 451. A base 442/452 is connected to a bottom of each of the two support 44, 45 so as to receive the pulley 46/47 corresponding thereto. The two scrolling cables 42, 43 are guided by rollers 551, 561 of two positioning members 55, 56 of the tilt unit 50 and are reeved through the pulleys 46, 47.

Figure 4B:
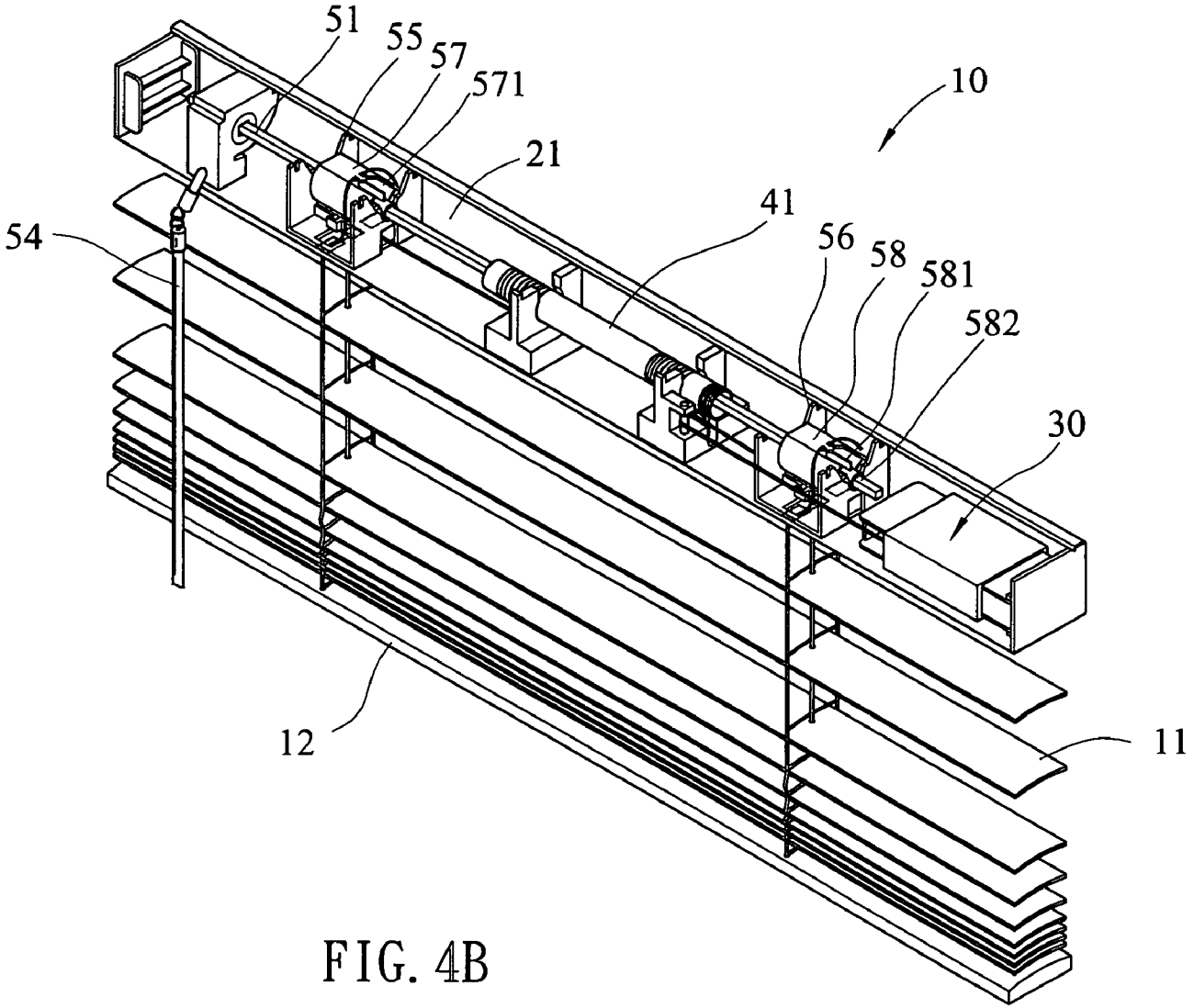
FIG. 4B is a perspective view to show the status in FIG. 4A.
Figure 5A:
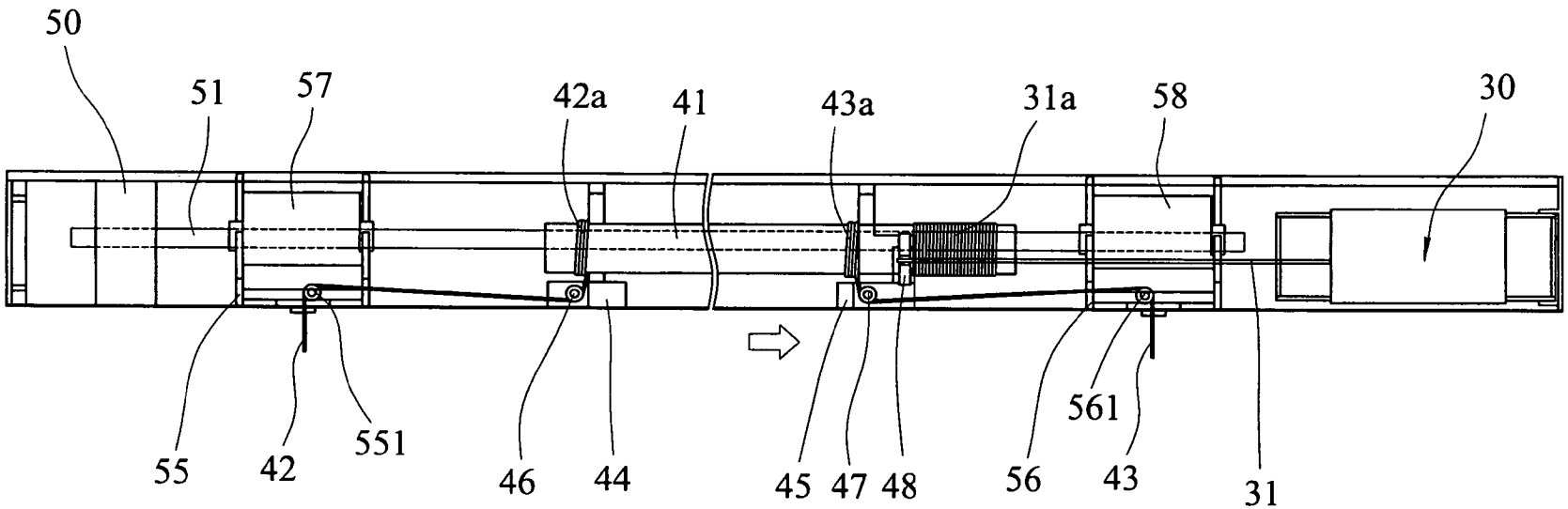
FIG. 5A shows the control mechanism of the cordless blind of the present invention, wherein the slats are fully expanded.
Figure 5B:
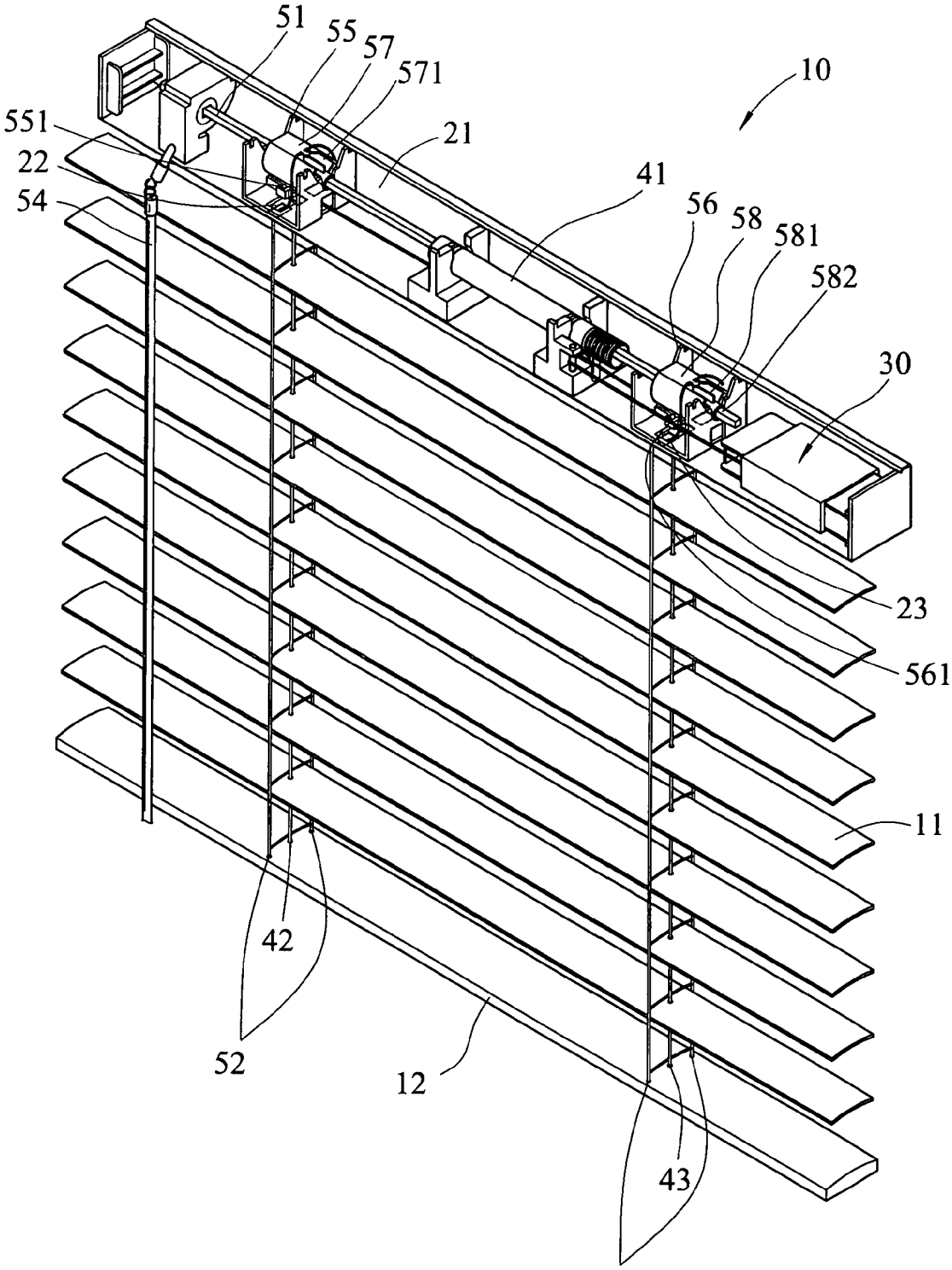
FIG. 5B is a perspective view to show the status in FIG. 5A.

The second and third wrapping portions 42*a*, 43*a* form a torque balance with the first wrapping portion 3 la so as to keep the slats 11 at their position as shown in FIGS. 4A and 4B. When the user holds the bottom rail 12 and pulls it downward, the balance of the toque between the second and third wrapping portions 42*a*, 43*a* and the first wrapping portion 31*a* is changed, so that the slats 11 is pulled downward as shown in FIGS. 5A and 5B. When the use releases the bottom rail 12, the balance of the toque between the second and third wrapping portions 42*a*, 43*a* and the first wrapping portion 31*a* is obtained again. Therefore, the slats 11 can be set at a desired height.

As shown in FIG. 5B, each of the two spinning members 57, 58 has a slot 572/582 with which the tilt member 51 is engaged such that the two spinning members 57, 58 are co-rotated, and the tilt member 51 extends through the scrolling rod 41. A tilt wand 54 is used to rotate the tilt member 51 to move the tilt cables 52, 53 moved upward and downward so as to tilt the slats 11.

While we have shown and described the embodiment in accordance with the present invention, it should be clear to those skilled in the art that further embodiments may be made without departing from the scope of the present invention.

What is claimed is:

1. A cordless blind comprising:

a top rail having a space defined therein;

a transmission unit received in the space and having a transmission cable extending therefrom, a scrolling rod connected to the transmission cable;

a scrolling unit received in the space and having two scrolling cables which have respective one of two ends thereof wrapped to two ends of the rod, the other end of each scrolling cables extending through the top rail and extending through parallel slats and being connected to a bottom rail, two inverted T-shaped supports fixedly connected to the top rail and each of the two supports having a notch defined in a top thereof, the scrolling rod being engaged with the two respective notches so as to be supported by the two supports, a base connected to a bottom of each of the two supports and two pulleys being received in the two respective bases of the two supports, the scrolling cables reeved through the two pulleys, and a tilt unit received in the space and having a tilt member, respective one of two ends of two tilt cables connected to two ends of the tilt member, the other end of each tilt cable extending through the top rail and connected to the parallel slats, the two scrolling cables being guided by rollers of two positioning members of the tilt unit, the two positioning members received in the space and two spinning members engaged with the positioning members respectively, each of the two spinning members having an engaging port so that the tilt cables are engaged with the engaging ports, each of the two spinning members having a slot with which the tilt member is engaged such that the two spinning members are co-rotated, the tilt member extending through the scrolling rod, a tilt wand rotating the tilt member to move the tilt cables moved upward and downward so as to tilt the slats.

2. The cordless blind claimed in claim 1, wherein the support that is located close to the transmission unit includes a tubular member and the transmission cable goes around the tubular member and is wrapped to the scrolling rod at a substantially right angle.

3. The cordless blind as claimed in claim 1, wherein each of the two positioning members has a holes through which the scrolling cable and the tilt cable extend.

4. The cordless blind as claimed in claim 3, wherein the rollers are located in the holes so that the scrolling cables pass around the rollers at substantially right angle.

* * * * *